US008631517B1

(12) United States Patent
Blakely

(10) Patent No.: US 8,631,517 B1
(45) Date of Patent: Jan. 21, 2014

(54) FABRIC FASTENER ADJUSTABLY LOCATED BETWEEN TWO PREFABRICATED GARMENT BUTTONS

(76) Inventor: John Ford Blakely, Del Mar, CA (US)

( * ) Notice: Subject to any disclaimer, the term of this patent is extended or adjusted under 35 U.S.C. 154(b) by 984 days.

(21) Appl. No.: 12/231,165

(22) Filed: Aug. 29, 2008

(51) Int. Cl.
*A41D 27/00* (2006.01)
*A41B 1/10* (2006.01)

(52) U.S. Cl.
USPC ..... 2/266; 2/96; 24/303

(58) Field of Classification Search
USPC ..... 2/77, 96, 265, 266, 113–128; 24/303
See application file for complete search history.

(56) References Cited

U.S. PATENT DOCUMENTS

| | | | | | |
|---|---|---|---|---|---|
| 139,937 | A * | 6/1873 | Wieser | 2/118 |
| 1,879,527 | A * | 9/1932 | Sansone | 2/127 |
| 2,786,207 | A * | 3/1957 | Abraham | 2/115 |
| 3,208,082 | A * | 9/1965 | Di Paolo | 2/219 |
| 3,614,815 | A * | 10/1971 | Nysten | 24/662 |
| 5,603,143 | A * | 2/1997 | Rucker | 24/90.1 |
| 5,644,794 | A * | 7/1997 | Hull et al. | 2/102 |
| 5,974,634 | A * | 11/1999 | Eisenpresser | 24/303 |
| 6,282,760 | B1 * | 9/2001 | Mars | 24/303 |
| 7,373,696 | B2 * | 5/2008 | Schoening et al. | 24/66.1 |
| 7,992,222 | B1 * | 8/2011 | Behrens | 2/128 |
| 2007/0028368 | A1 * | 2/2007 | Morton | 2/265 |

FOREIGN PATENT DOCUMENTS

| | | | |
|---|---|---|---|
| GB | 840189 | A * | 7/1960 |
| JP | 2001040515 | A * | 2/2001 |
| JP | 2004105605 | A * | 4/2004 |
| JP | 2005028022 | A * | 2/2005 |
| JP | 2008018051 | A * | 1/2008 |

* cited by examiner

*Primary Examiner* — Robert J Sandy
(74) *Attorney, Agent, or Firm* — Robert Z. Evora, Esq.

(57) ABSTRACT

A garment securing device and adjustable positioning thereof. The garment securing device is a fabric fastener adjustably located between two prefabricated garment buttons. The fabric fastener adapted to secure a first shirt panel to a second shirt panel of a dress shirt including a collar button, a first torso button, and a second torso button, all symmetrically positioned and including associated eyelets. The fabric fastener includes a clothing button firmly attached with an adhesive to a first permanent magnet. The combination of a second permanent magnet and the first permanent magnet is to provide an alignment and the securing of the first shirt panel and the second shirt panel to each other between the first torso button and the second torso button.

10 Claims, 6 Drawing Sheets

FIG. 10
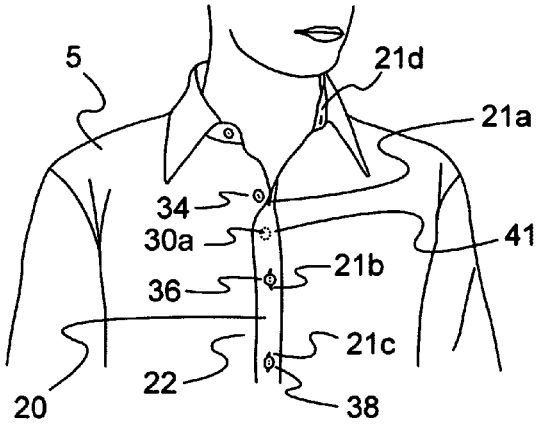
FIG. 11
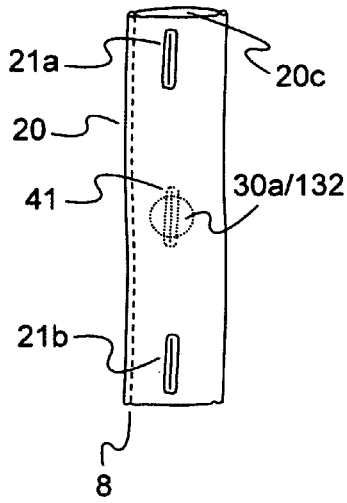
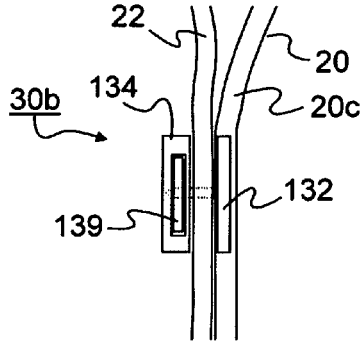
FIG. 12
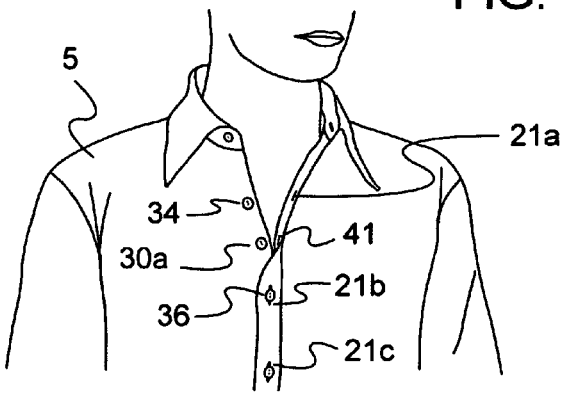
FIG. 14
FIG. 13
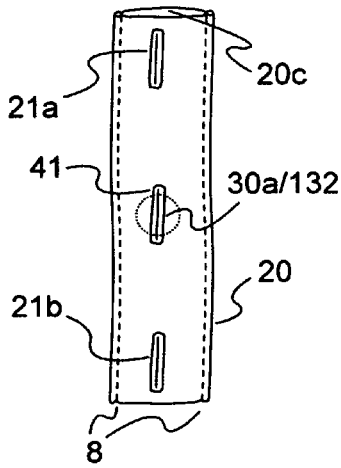

FABRIC FASTENER ADJUSTABLY LOCATED BETWEEN TWO PREFABRICATED GARMENT BUTTONS

BACKGROUND OF THE INVENTION

1. Field of the Invention

This invention relates to a garment securing device and the adjustable positioning thereof, and particularly, to the construction of a fabric fastener, and the adjustable use of the fabric fastener between two prefabricated garment buttons for securing various garments worn by a person.

2. Description of the Related Art

Conventionally, garments worn by a person have been fastened together using sewn buttons, belts, snaps, zippers, hook-and-loop fasteners, and the like.

Dress shirts are typically secured to a person's neck, torso and arms using various fasteners, such as: buttons, clasps, cuff-links, and the like. Since people are different in size and shape, it is difficult to design a single shirt that will fit every user. As such, the problem lies in the being able to quickly adapt the shirt to various people by securely adding a fastener to the shirt without having to laboriously sew a new button on the shirt and/or include an additional eyelet to receive the new button.

It is clear that this problem has not been solved and there is still a longstanding need for a multipurpose fabric fastener that can be quickly and securely implemented with conventional shirts. In accordance with this invention, an exemplary magnetic fabric fastener and configuration is described and shown below which solves this problem.

SUMMARY OF THE INVENTION

The present invention addresses the shortcomings identified in providing a fabric fastener.

An object of this invention is to provide a magnetic fabric fastener adapted to secure a first shirt panel to a second shirt panel of a dress shirt including a collar button, a first torso button, and a second torso button, all symmetrically positioned and including associated eyelets. The magnetic fabric fastener includes a first permanent magnet firmly attached with an adhesive to a button. The clothing button is added to the magnetic fabric fastener to camouflage the fastener so that it appears as though the button is originally a part of the shirt. The combination of a second permanent magnet and the first permanent magnet is to provide an alignment and the securing of the first shirt panel and the second shirt panel to each other between the first torso button and the second torso button. An attractive magnetic force is produced between the first and second permanent magnets to secure the first shirt panel and the second shirt panel in a fixed position.

It is another aspect of this invention to further provide a magnetic fabric fastener including a clasp having an aperture. A pin is provided having a sharp end shaft that extends from a base. The sharp end shaft includes a retaining groove adjacent to a peripheral edge. The sharp end shaft is adapted to be received in the aperture of the clasp. A releasable lever engages and captivates the retaining groove when it is placed in the clasp.

Another aspect of this invention is to dispose a fabric fastener at an intermediate hidden position between two adjacent prefabricated buttons, such that an associated eyelet may not be visible from a front view of the front shirt panel, but may be visible from a rear view of the front shirt panel.

The front shirt panel may include parallel stitching that forms a pocket along the front shirt panel extending from a neck to a waist region of the shirt. In the pocket, more than one intermediate eyelet may be disposed on the front shirt panel to receive the fabric fastener in a position aligned with any one of the various associated intermediate buttons.

According to another aspect of this invention, a fabric fastener is used to secure a first shirt panel to a second shirt panel of a dress shirt including a collar button, a first torso button, and a second torso button, a plurality of additional torso button. All of the torso buttons are symmetrically positioned and associated eyelets for positioning are also symmetrically positioned to receive the various torso buttons. An intermediate button; and an intermediate eyelet adapted to receive the intermediate button is also provided to align and secure the first shirt panel and the second shirt panel to each other between the first torso button and the second torso button.

More than one intermediate button may be aligned with more than one associate intermediate eyelet at a position between the two already existing prefabricated torso buttons sewn onto the garment and are likewise adapted to prevent the garment from gaping open.

These and other objects, features, and/or advantages may accrue from various aspects of embodiments of the present invention, as described in more detail below.

BRIEF DESCRIPTION OF THE DRAWINGS

Various exemplary embodiments of this invention will be described in detail, wherein like reference numerals refer to identical or similar components or steps, with reference to the following figures, wherein:

FIG. 10 is an illustration of a first embodiment for a dress shirt including a button and hidden intermediate button eyelet configuration employing the fabric fastener in accordance with this invention.

FIG. 11 shows a front view of the front shirt panel illustrating the hidden intermediate button eyelet configuration representing the intermediate button eyelet being only visible from the rear side of the front shirt panel and not from the front side of the front shirt panel in accordance with this invention.

FIG. 12 is an illustration of front shirt panel opened to display the intermediate button and eyelet configuration and the fabric fastener shown in hidden line to represent that, in use, the fabric fastener is disposed within a pocket formed by the front shirt panel in accordance with this invention.

FIG. 13 shows a rear view of the front shirt panel illustrating the hidden intermediate button eyelet configuration in accordance with this invention.

FIG. 14 is an illustration of a fabric fastener disposed, in part, within a pocket and securing the first shirt panel to the second shirt panel in accordance with this invention.

DETAILED DESCRIPTION OF EXEMPLARY EMBODIMENTS

Particular embodiments of the present invention will now be described in greater detail with reference to the figures.

Figure 1:
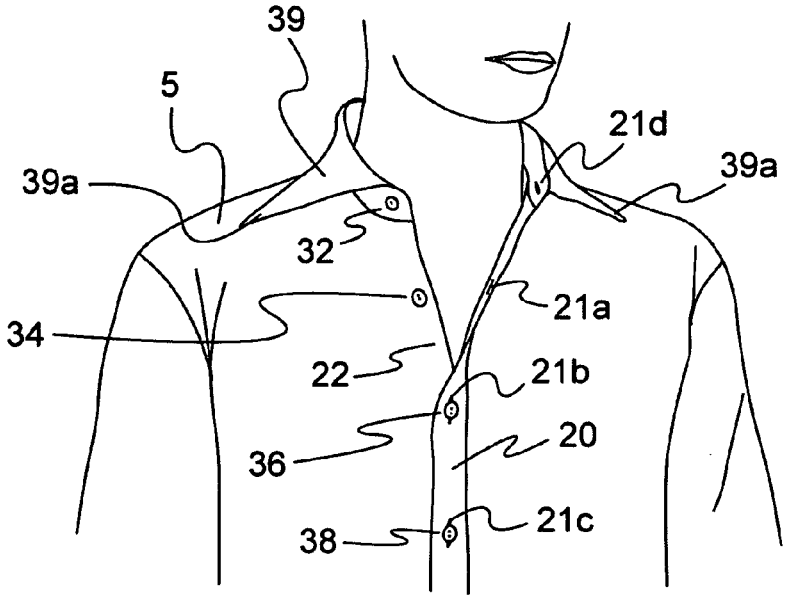
FIG. 1 is an exemplary illustration of a traditional dress shirt.

FIG. 1 is an exemplary illustration of a traditional dress shirt 5. As shown, the dress shirt 5 includes a front shirt panel 20 and a rear shirt panel 22. The front shirt panel 20 is shown attached to the rear shirt panel 22 with a plurality of fasteners and mating eyelet holes 21 adapted to receive the various fasteners. For exemplary purposes, the plurality of fasteners may be defined as a collar button 32, a first torso button 34, a second torso button 36, and at least another third torso button 38.

Figure 2:
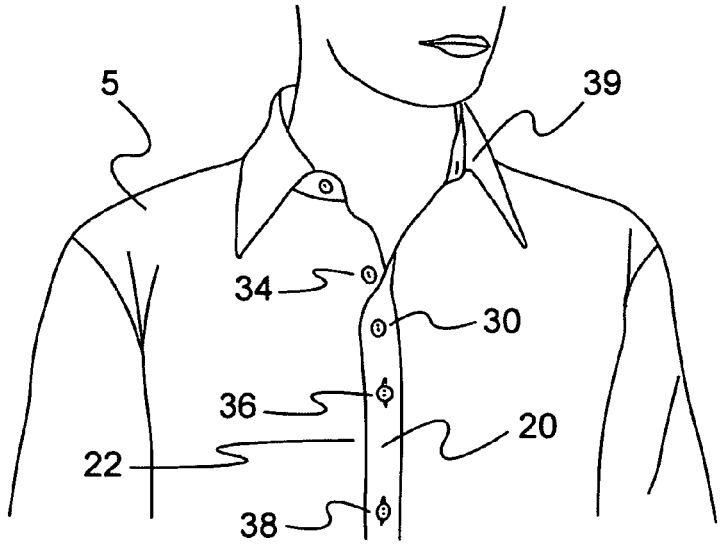
FIG. 2 is an exemplary illustration of a dress shirt employing the magnetic fabric fastener in accordance with this invention.

FIG. 2 is an exemplary illustration of the dress shirt 5 employing a quick release fastener in position between the first torso button 34 and the second torso button 36 in accordance with this invention. Various quick release fasteners may be employed. According to this exemplary embodiment, the quick release fastener may be a magnetic fabric fastener 30. As constructed, no time consuming stitching is required, and a new eyelet also does not need to be sewn to receive the magnetic fabric fastener 30.

The placement of the magnetic fabric fastener 30 on the prefabricated dress shirt 5 in an intermediate position between two pre-positioned adjacent buttons on a dress shirt is another unique aspect of this invention. Frequently, a person wearing a dress shirt, blouse and/or other garment has a need to add an additional button fastener between two already existing prefabricated buttons to prevent the garment from gaping open between buttons. An aspect of this invention includes adhering the button to the fabric fastener so that the appearance of the button camouflages the fastener in a manner which depicts the original placement on the shirt as manufactured. Likewise, there is frequently a need to prevent wide gaping necklines which may otherwise appear untidy, embarrassing, and/or inappropriate in a business workplace.

By way of example, and as shown in FIG. 2, the magnetic fabric fastener 30 may be placed between the first torso button 34 and the second torso button 36 in order to reduce the wide open gaping neckline as shown in FIG. 1. The placement of the magnetic fabric fastener 30 advantageously brings the collar 39 closer in together, thereby biasing the collar 39 upright and preventing it from flattening out in an untidy fashion as shown in FIG. 1.

Figure 3:
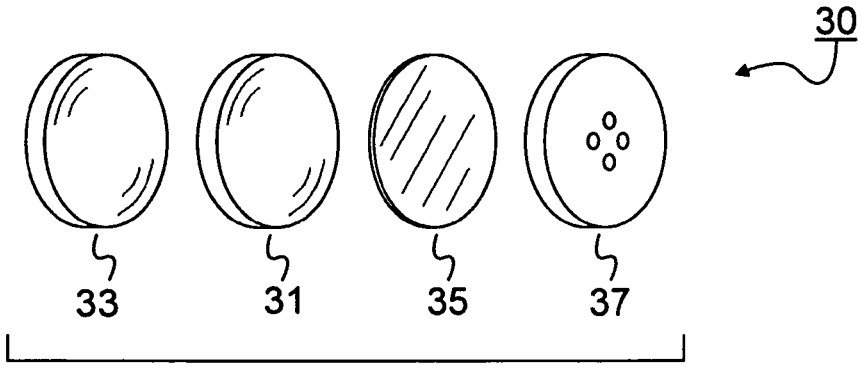
FIG. 3 is an exemplary exploded view of a first embodiment of the magnetic fabric fastener in accordance with this invention.

FIG. 3 is an exemplary exploded view of the magnetic fabric fastener 30 in accordance with this invention. The magnetic fabric fastener 30 includes a button 37 attached via an adhesive 35 to a first magnet 31, which is magnetically attracted to a second magnet 33. It is to be understood that various types of buttons may be used in accordance with this invention, including, but not limited to, a clothing button, and the like.

The magnets 31, 33 may be made from a highly magnetically attractive rare Earth material, such as Neodymium Iron Boron (NdFeB), sintered to form a permanent magnet, and/or any other material having strong magnetic attractive force properties in accordance with this invention. It is to be understood that various magnetically attractive magnets and/or material fasteners having attraction force properties may be used which are, now known or later discovered, in accordance with this invention.

It is to be understood that various adhesive materials and/or processes may be employed to secure the button to the first magnet 31. Likewise, various ornamental coverings may be used instead of the button 37.

An advantage of this invention is to leverage the use of the spare button that is commonly sewn inconspicuously onto a garment that is purposely added by the garment manufacturer for alternative use in the event that the user loses one of the pre-positioned buttons 32, 36, 38. According to this invention, the spare button is utilized in combination with the multipurpose magnetic button as will be described to give the appearance and effect as though the spare button is sewn in or affixed to the garment as it would have been right from the manufacturer or a seamstress who had attached the spare button as a regular use button.

Figure 4:
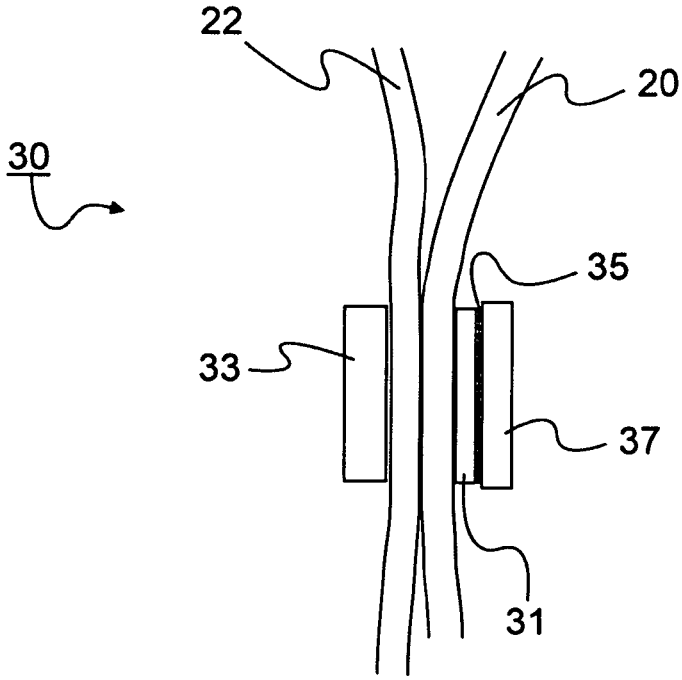
FIG. 4 is an exemplary illustration of the magnetic fabric fastener securing a front shirt panel to a rear shirt panel in accordance with this invention.

FIG. 4 is an exemplary illustration of the magnetic fabric fastener 30 securing a front shirt panel 20 to a rear shirt panel 22 in accordance with this invention. In use, the second magnet 33 is positioned behind the rear shirt panel 22 at a preferred position. Likewise, the first magnet 31 is positioned in front of the front shirt panel 20 and aligned with the second magnet 33 to secure the front shirt panel 20 to a rear shirt panel 22.

Figure 5:
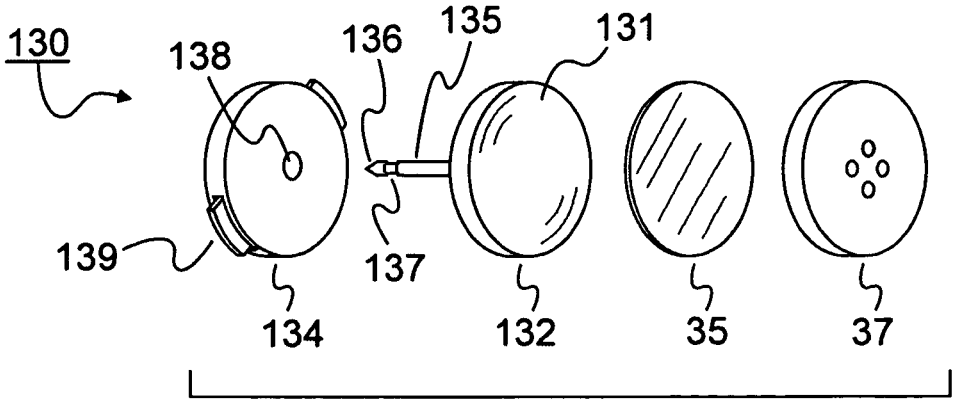
FIG. 5 is an exemplary exploded view of a second embodiment of the fabric fastener in accordance with this invention.

FIG. 5 is an exploded view of a second embodiment for a fabric fastener 130 in accordance with another aspect of this invention. In accordance with this exemplary embodiment, it is not necessary to construct the fabric fastener from a magnet, as was done with respect to FIG. 3. The fabric fastener 130 includes a button 37 attached via an adhesive 35 to a first base 131. A pin 132 is adapted to be fastened to a clasp 134. The pin 132 includes a base 131 with a shaft 135 including a sharp tip 136 and a retaining groove 137. The clasp 134 includes an aperture 138, into which the sharp tip 136 of the pin 132 is inserted. A releasable lever 139 is adapted to engage and captivate the retaining groove 137 on the shaft 135 of the pin 132.

Any portion of the pin 131 and the clasp 134 may be composed of a metallic and/or a magnetic material so that an attraction force may be produced between the pin 131 and the clasp 134 in order to further secure the front shirt panel 20 and the rear shirt panel 22 to each other. As such, it is also possible to rely on the attraction force produced instead of the clasp 134 and the retaining groove 137 to secure the pin 131 and the clasp 134 to each other.

Figure 6:
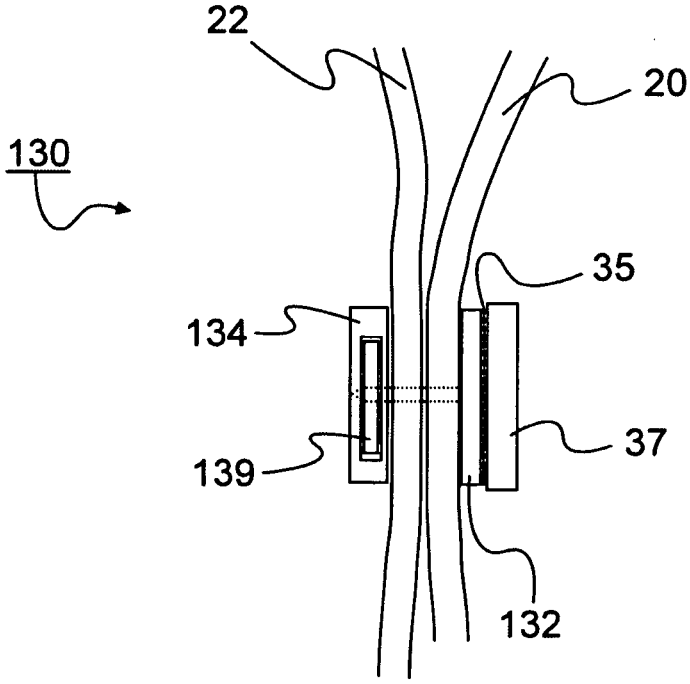
FIG. 6 is an exemplary illustration of the fabric fastener securing a front shirt panel to a rear shirt panel in accordance with this invention.

FIG. 6 is an exemplary illustration of the fabric fastener 130 securing the front shirt panel 20 to the rear shirt panel 22 in accordance with this invention. In use, the pin 132 is positioned at a preferred position where the fabric fastener 130 is to be secured, and the sharp tip 136 is pressed through the front shirt panel 20 and the rear shirt panel 22 and secured in position by the clasp 134.

The clasp 134 is pushed on to the shaft 135 of the pin 132 far enough so that the releasable lever 139 can engage and captivate the retaining groove 137 on the shaft 135 of the pin 132. An advantage of this embodiment for the fabric fastener 130 is that the fabric fastener 130 will not shift from a preferred position on the dress shirt 5.

Figure 7:
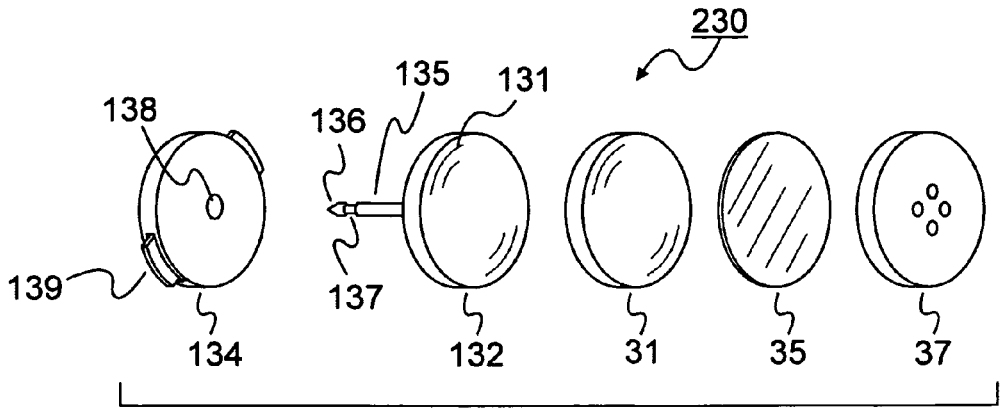
FIG. 7 is an exemplary exploded view of a third embodiment of the fabric fastener in accordance with this invention.

FIG. 7 is an exploded view of another exemplary embodiment for a fabric fastener in accordance with another aspect of this invention. The fabric fastener is a magnetic fabric fastener 230 which, as shown, includes a button 37 attached to a first magnet 31 with an adhesive 35. A pin 131 is adapted to be fastened to a clasp 134. The pin 132 includes a base 131 with a shaft 135 having a sharp tip 136 and a retaining groove 137. The clasp 134 further includes an aperture 138, into which the sharp tip 136 is inserted, and a releasable lever 139 is adapted to engage and captivate the retaining groove 137 on the shaft 135 of the pin 132. To enhance the fastening properties of the magnetic fabric fastener 130, any portion of the pin 132 and the clasp 134 may be constructed of a magnetic material.

Figure 8:
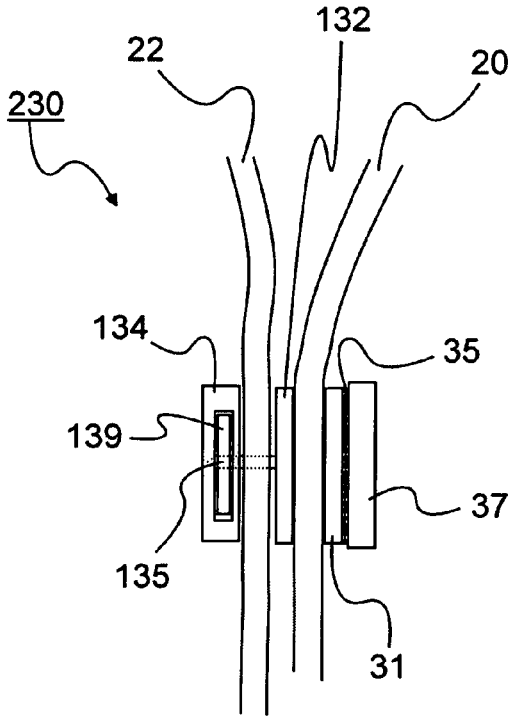
FIG. 8 is an exemplary illustration of the fabric fastener securing a front shirt panel to a rear shirt panel in accordance with this invention.

FIG. 8 is an exemplary illustration of the magnetic fabric fastener 230 securing the front shirt panel 20 to the rear shirt panel 22 in accordance with this invention. In use, the pin 132 is positioned at a preferred position where the magnetic fabric fastener 230 is to be located, and the sharp tip 135 is pressed through the rear shirt panel 22 and secured in position by the clasp 134. The clasp 134 is pushed onto the shaft 135 of the pin 132 so that the releasable lever 139 can engage and captivate the retaining groove 137 on the shaft 135 of the pin 132. The first magnet 31 is then positioned in front of the front shirt panel 20 and aligned with the metallic pin 132 so that the second magnet 33 may be magnetically secure the front shirt panel 20 adjacent to the rear shirt panel 22.

One advantage of this embodiment is that the magnetic fabric fastener 230 will not shift on the front shirt panel 20 or the rear shirt panel 22 as easily from a preferred position in which the magnetic fabric fastener 230 is intended to be aligned. Shifting will not occur because the pin 132 and the clasp 134 are immovably fastened in place.

Figure 9:
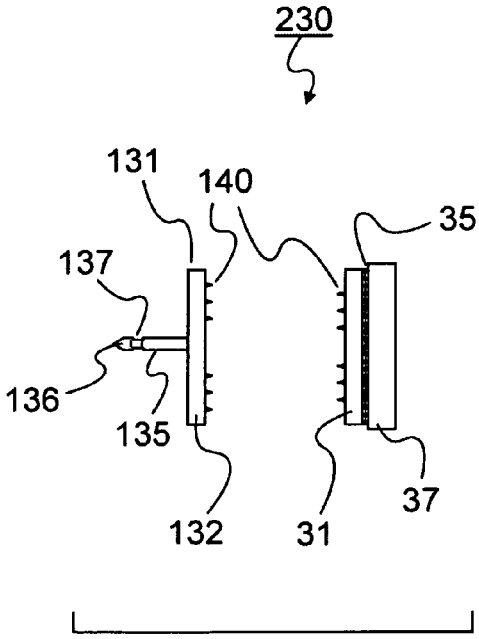
FIG. 9 is a partial exploded view of yet another exemplary embodiment for the fabric fastener including a gripping mechanism in accordance with this invention.

FIG. 9 is a partial exploded view of yet another exemplary embodiment for the magnetic fabric fastener 230 including an alignment mechanism in accordance with this invention. As shown, the magnetic fabric fastener 230 may further include various teeth 140 on the surface of the base 131 of the pin 132 and an adjacent surface on the first magnet 31.

In use, the teeth 140 will grab onto both sides of the front shirt panel 20 and prevent the magnetic fabric fastener 130 from slipping from a preferred position. It is to be understood that the teeth 140 may be suitably placed on any of the various surfaces of the magnetic fabric fastener 30, 130, 230 embodiments described herein, in order to prevent slipping of the magnetic fabric fastener in accordance with this invention.

FIG. 10 is an illustration of another embodiment for a dress shirt including a fastener and a hidden intermediate button eyelet 41 configuration. Various types of fasteners may be employed in accordance with this invention. By way of example, the fastener employed may be a regular sewn in button and/or the multipurpose fabric fasteners 30, 130, 230 as described above.

For exemplary purposes, the fastener will be shown as a fixed sewn in intermediate button fastener 30*a* in accordance with this invention. The hidden intermediate button eyelet 41 is disposed between two adjacent prefabricated button fasteners 34, 36. For purposes of illustration, in FIGS. 10-13, the intermediate button fastener 30*a* and the hidden intermediate button eyelet 41 are depicted in a preferred position between the first torso button 34 and the second torso button 36.

FIG. 11 depicts a front view of the front shirt panel 20. As shown, the top eyelet 21*a* (aligned to receive the first torso button 34), and the lower eyelet 21*b* (aligned to receive the second torso button 36), are visible from the front view. However, the intermediate button fastener 30*a* and the intermediate button eyelet 41 are shown in hidden lines to demonstrate that they are not visible from the front view of the front shirt panel 20.

FIG. 12 is an illustration of front shirt panel opened to display the placement of intermediate button fastener 30*a* and the intermediate button eyelet 41 in accordance with this invention. As shown, the intermediate button fastener 30*a* and hidden intermediate button eyelet 41 are arranged and disposed between the first torso button 34 and the second torso button 36.

FIG. 13 depicts a rear view of the front shirt panel 20. As shown, the top eyelet 21*a*, the intermediate button eyelet 41, and the lower eyelet 21*b* are all visible from the rear view of the front shirt panel 20. In use, the intermediate button fastener 30*a* is positioned within the intermediate button eyelet 41 so that the front shirt panel 20 and the rear shirt panel 22 may be secured to each other.

The front shirt panel 20 may be constructed to include stitching 8 on one side (as shown in FIG. 11) and/or stitching 8 may be disposed on both sides of the front shirt panel 20 (as shown in FIG. 13). The advantage of having the stitching 8 on both sides of the front shirt panel 20 is to provide for a more secure fit to the intermediate button fastener 30*a*, since the stitching 8 on both sides of the front shirt panel 20 will captivate the intermediate button fastener 30*a*.

Likewise, it is to be understood, that any of the multipurpose magnetic buttons 30, 13, 230 may be used instead of the intermediate button fastener 30*a* described above. That is, in use, a multipurpose magnetic button 30, 130, 230 may be positioned within the intermediate button eyelet 41 so that the front shirt panel 20 and the rear shirt panel 22 may be magnetically secured to each other.

FIG. 14 depicts another exemplary fabric fastener 30*b* construction in accordance with another aspect of this invention. It is to be understood that the fabric fastener 30*b*, used in combination with the intermediate button eyelet 41, may simply be a pin 132 and clasp 134 for the pin of any type. By way of example, and referring back to the multipurpose magnetic button 130 shown in FIG. 5, only the pin 132 and clasp 134 portion may be necessary as a basic pin 132 and clasp 134 fastener combination for use with the intermediate button eyelet 41 as shown in FIGS. 11, 13 and 14. Because the pin 132 portion of the fabric fastener 30*b* required to mate with the intermediate button eyelet 41 will not be shown (since it is tucked into a pocket 20*c* defined in-between the front shirt panel 20 and not visible from the front side of the front shirt panel 20), it is not necessary to attach the button 37 to the pin 132 with an adhesive 35 for aesthetic purposes.

As shown in FIGS. 11, 13 and 14, a pin 132 portion may be used (instead of the intermediate button fastener 30*a*) as the portion of the fabric fastener 30*b* that slips into a pocket 20*c* formed in the front shirt panel 20. In use, the pin 132 is positioned within the intermediate button eyelet 41 where the fabric fastener 30*b* is to be secured, and the sharp tip 136 is pressed through a portion of the front shirt panel 20 and the rear shirt panel 22 and secured in position by the clasp 134 on the back side of the rear shirt panel 22. The clasp 134 is pushed on to the shaft 135 of the pin 132 far enough so that the releasable lever 139 can engage and captivate the retaining groove 137 on the shaft 135 of the pin 132.

Although not shown, it is also possible to modify the intermediate button eyelet 41 and the front shirt panel 20 to include a pouch into which the first magnet 31 may be captivated, and the second magnet 33 may be positioned behind the second shirt panel 22 to magnetically secure the second shirt panel 22 to the first magnet 31 disposed within a pouch disposed within the first shirt panel 20. It is to be understood that, with the use of the magnetic fabric fastener, there is no need to have an associated eyelet disposed within the front shirt panel 20.

Figure 15:
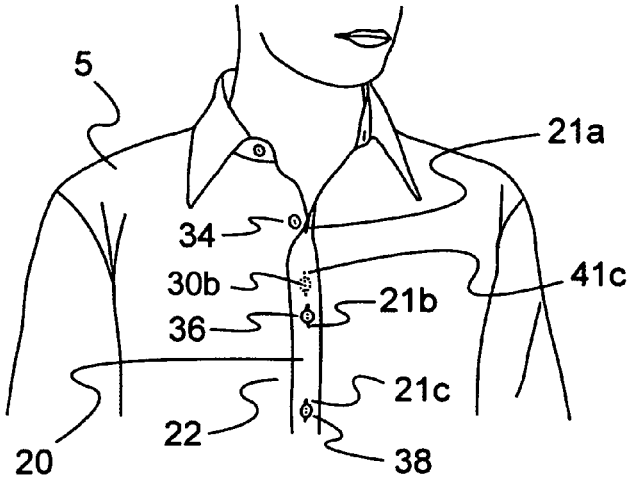
FIG. 15 is an illustration of a second embodiment for a dress shirt including an adjustable button and various hidden intermediate button eyelet configurations in accordance with this invention.

FIG. 15 is an illustration of another exemplary embodiment for a dress shirt including at least one fabric fastener 30*b* having a pin 132 and a clasp 134 as shown and described before in FIG. 14. The fabric fastener 30*b* is removably adjustable and may be positioned for use at a location corresponding to any one of the various hidden intermediate button eyelets 41*a*, 41*b*, 41*c* which are positioned between two adjacent button eyelets 21*a* and 21*b*, which correspond to the first torso button 34 and the second torso button 36, respectively.

As shown and mentioned above, the pin 132 portion of the fabric fastener 30*b* required to mate with at least one of the intermediate button eyelets 41*a*, 41*b*, 41*c*, will not be shown (since it is tucked into a pocket 20*c* defined in-between the front shirt panel 20 and not visible from the front side of the front shirt panel 20). The advantage to having a plurality of intermediate button eyelets 41*a*, 41*b*, 41*c* is that the use may be able to adjustably fasten their shirt 5 into a number of different positions between the first torso button 34 and the second torso button 36.

Figure 16:
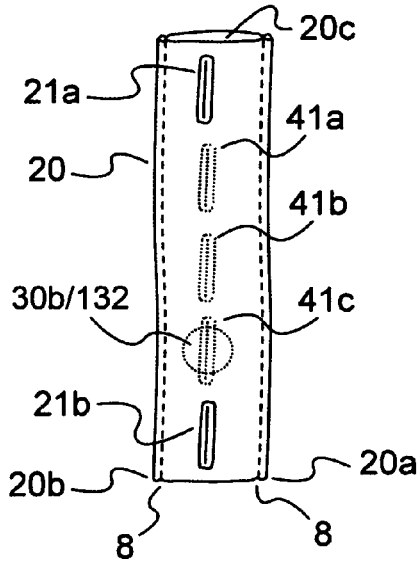
FIG. 16 shows a front view of the front shirt panel illustrating the various hidden intermediate button eyelet configurations wherein the intermediate button eyelets are only visible from the rear side of the front shirt panel and not from the front side of the front shirt panel in accordance with this invention.
Figure 18:
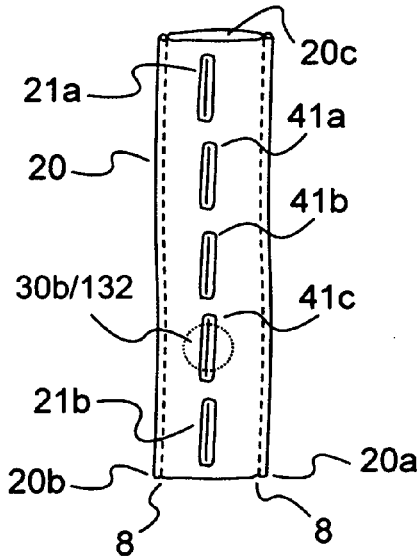
FIG. 18 shows a rear view of the front shirt panel illustrating the various hidden intermediate button eyelet configuration in accordance with this invention.

The pin 132 portion may be slipped into the pocket 20*c* formed in the front shirt panel 20. In use, the pin 132 is positioned within at least one of the intermediate button eyelets 41*a*, 41*b*, 41*c* at a location where the fabric fastener 30*b* is to be secured. As shown in FIGS. 16 and 18, the fabric fastener multipurpose magnetic button 30*b* is aligned with intermediate button eyelet 41*c*. As shown in FIG. 14, the sharp tip 136 of the fabric fastener 30*b* is pressed through a portion of the front shirt panel 20 and the rear shirt panel 22 and secured in position by the clasp 134 on the back side of the rear shirt panel 22. The clasp 134 is pushed on to the shaft 135 of the pin 132 far enough so that the releasable lever 139 can engage and captivate the retaining groove 137 on the shaft 135 of the pin 132.

Although shown as a removable and adjustable fabric fastener 30*b*, various types of fasteners may be employed in accordance with this invention. By way of example, the fastener(s) employed may be a regular sewn in button and/or plurality of buttons, or the multipurpose magnetic buttons 30, 130, 230 as described above.

FIG. 16 depicts a front view of the front shirt panel 20. As shown, the top eyelet 21*a* (aligned to receive the first torso button 34), and the lower eyelet 21*b* (aligned to receive the second torso button 36), are visible from the front view. However, the fabric fastener 30*b* and the hidden intermediate button eyelet 41*c* are shown in hidden lines to demonstrate that they are not visible from the front view of the front shirt panel 20. It is to be understood that the fabric fastener 30*b* may be received by any one of the hidden intermediate button eyelets 41*a*, 41*b*, 41*c* that are disposed between the first torso button 34 and the second torso button 36.

Figure 17:
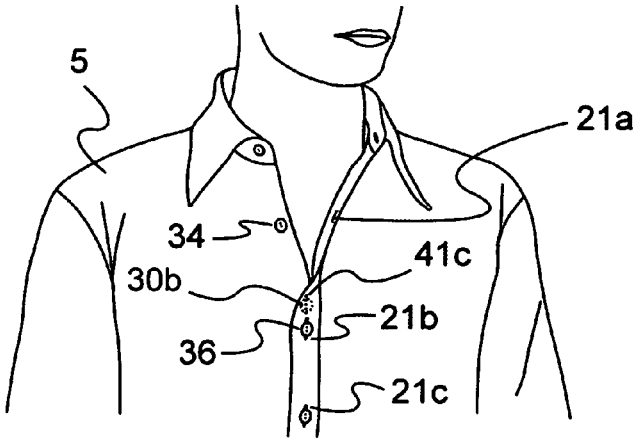
FIG. 17 is an illustration of the front shirt panel partially opened down to the position of one of the intermediate buttons in accordance with this invention.

FIG. 17 is an illustration of front shirt panel 20 opened to display the placement of fabric fastener 30*b* and the intermediate button eyelet 41 in accordance with this invention. As shown, the fabric fastener 30*b* and the hidden intermediate button eyelets 41*a*, 41*b*, 41*c* are arranged and disposed between the first torso button 34 and the second torso button 36.

FIG. 18 depicts a rear view of the front shirt panel 20. As shown, the top eyelet 21*a*, the hidden intermediate button eyelets 41*a*, 41*b*, 41*c*, and the lower eyelet 21*b* are all visible from the rear view of the front shirt panel 20. In use, the fabric fastener 30*b* is positioned within the intermediate button eyelet 41*c* so that the front shirt panel 20 and the rear shirt panel 22 may be secured to each other. Likewise, the fabric fastener 30*b* may have been positioned for closure at any one of the hidden intermediate button eyelet 41*a*, 41*b*, 41*c* positions.

As mentioned previously, the front shirt panel 20 may be constructed to include stitching 8 on one side (as shown in FIG. 11) and/or stitching 8 may be disposed on both sides 20*a*, 20*b* (as shown in FIG. 16) of the front shirt panel 20 (as shown in FIGS. 13, 16 and 18) to provide for a more secure fit to at least one of the chosen intermediate fastener(s) 30*a*, 30*b*, 30.

Although, for exemplary purposes, the multipurpose magnetic button 30, 130, 230 was depicted, it is to be understood that a sewn in button fastener 30*a* may be used. That is, in use, the intermediate button fastener 30*a* may be sewn in adjacent to any of the intermediate button eyelets 41*a*, 41*b*, and 41*c* for use therewith. As described above, a pouch may be integrated within the front shirt panel 20 to receive the chosen intermediate fastener(s) 30*a*, 30*b*, 30 in accordance with this invention.

It is to be understood, that various types of fabric fasteners 30, 30*b*, 130, and 230 (also referred to herein as an intermediate fabric fasteners and/or a readjustable intermediate fabric fasteners) have been described herein. The various fabric fasteners may operate for a specific use, and/or overlapping use. For example, referring to FIGS. 11 and 16, where a sewn-in fabric fastener is to be used (such as a clothing button), a single intermediate eyelet may be a preferred option and may be associated with the fixed sewn-in fabric fastener. Likewise, where the fabric fastener (shown and describe in FIGS. 5 and 14) is used, an intermediate eyelet may be useful to secure a portion of the fabric fastener 30*b*, 130. The same may be said of the fabric fastener 230 shown and described in FIG. 7. However, for the use of the fabric fastener 230 of FIG. 7, the intermediate eyelet may not be necessary because of the magnetic attraction inherent in the use of this fabric fastener which will align the first shirt panel with the second shirt panel.

It will be recognized by those skilled in the art that changes or modifications may be made to the above described embodiments without departing from the broad inventive concepts of the invention. It is understood therefore that the invention is not limited to the particular embodiments which are described, but is intended to cover all modifications and changes within the scope and spirit of the invention.

What is claimed is:

1. A dress shirt comprising:

a fabric fastener securing a first shirt panel to a second shirt panel of the dress shirt including a collar button, a first torso button, and a second torso button, a plurality of additional torso buttons, all torso buttons being symmetrically positioned and including associated eyelets for positioning therein, further comprising:

an intermediate button fastener; and an intermediate eyelet not visible from a front view of the first shirt panel, but is visible from a rear view of the first shirt panel and is adapted to receive the intermediate button fastener, wherein the intermediate button fastener aligns and secures the first shirt panel and the second shirt panel to each other between the first torso button and the second torso button; and wherein the first shirt panel includes parallel stitching that form a pocket along the first shirt panel, whose parallel stitching closes the pocket and extends lengthwise from a neck to a waist region of the shirt, into which various intermediate eyelets are disposed to receive the entire associated intermediate button fastener within the pocket.

2. The dress shirt as recited in claim 1, wherein the fabric fastener is placed at an intermediate position between two already existing prefabricated torso buttons sewn onto the dress shirt to prevent the dress shirt from gaping open.

3. The dress shirt as recited in claim 1, wherein the intermediate fastener is adjustable, and is capable of being aligned with any one of a number of associate intermediate eyelets adapted to receive the adjustable intermediate button at any position between the two already existing prefabricated torso buttons sewn onto the dress shirt to prevent the dress shirt from gaping open.

4. A dress shirt comprising:

a hidden fastener arrangement securing a first shirt panel to a second shirt panel of the dress shirt including a first torso button, a second torso button, and a plurality of additional torso buttons, all torso buttons being symmetrically positioned and including associated eyelets for positioning various fasteners therein, further comprising:

an intermediate button fastener; and a hidden intermediate eyelet adapted to receive the intermediate button fastener, wherein the intermediate button fastener aligns and secures the first shirt panel and the second shirt panel to each other between the first torso button and the second torso button, and wherein the first shirt panel includes a parallel stitched pocket whose stitching closes the pocket and extends lengthwise from the first torso button to the second torso button, into which various hidden intermediate eyelets are disposed to receive the associated intermediate button fastener within the pocket.

5. The dress shirt as recited in claim 4, wherein the intermediate button fastener is placed at an intermediate position between the first torso button and the second torso button along the first shirt panel to prevent the dress shirt from gaping open.

6. The dress shirt as recited in claim 5, wherein the intermediate position between the first torso button and the second torso is anywhere along the first shirt panel.

7. A garment comprising:

a hidden fastener arrangement securing a first panel to a second panel of the garment including a first torso button and a second torso button, the first and second torso buttons including associated eyelets for positioning various fasteners therein, further comprising:

an intermediate button fastener; and a hidden intermediate eyelet adapted to receive the intermediate button fastener, wherein the intermediate fastener secures the first panel and the second panel to each other at an intermediate position between the first torso button and the second torso button, and wherein the first panel includes a closed parallel stitched pocket running lengthwise from the first torso button to the second torso button, into which the hidden intermediate eyelet is disposed to receive the associated intermediate button fastener within the pocket.

8. The garment as recited in claim 7, wherein the intermediate button fastener is placed at an intermediate position between the first torso button and the second torso button along the first panel to prevent the garment from gaping open.

9. The garment as recited in claim 7, wherein the intermediate position between the first torso button and the second torso button is anywhere along the first panel on the pocket.

10. The garment as recited in claim 7, where, in the intermediate position along the first panel, a plurality of additional torso buttons are included and symmetrically positioned adjacent to associated eyelets for positioning therein.

* * * * *